US005823239A

United States Patent [19]

Smith

[11] Patent Number: 5,823,239

[45] Date of Patent: Oct. 20, 1998

[54] WORK BENCH

[75] Inventor: Darrin E. Smith, Penetanguishene, Canada

[73] Assignee: Jessem Products Limited, Ontario, Canada

[21] Appl. No.: 875,397

[22] PCT Filed: Jan. 26, 1996

[86] PCT No.: PCT/CA96/00053

§ 371 Date: Jul. 30, 1997

§ 102(e) Date: Jul. 30, 1997

[87] PCT Pub. No.: WO96/23634

PCT Pub. Date: Aug. 8, 1996

[30] Foreign Application Priority Data

Jan. 31, 1995 [CA] Canada ..... 2141468

[51] Int. Cl.[6] ..... B27C 5/02; B27B 1/00; B25H 1/00

[52] U.S. Cl. ..... 144/135.2; 144/134.1; 144/136.1; 144/204.2; 144/253.2; 144/253.5; 144/286.1

[58] Field of Search ..... 144/1.1, 134.1, 144/135.2, 136.1, 253.1, 253.2, 253.4, 253.5, 204.02, 286.1, 286.5

[56] References Cited

U.S. PATENT DOCUMENTS 3,060,981 10/1962 Hofmann .
3,096,798 7/1963 Pugsley .
3,134,411 5/1964 Broyles .
3,172,417 3/1965 Zulkowitz et al. .
3,604,484 9/1971 Viljoen ..... 144/135.2
3,692,075 9/1972 White .
4,056,137 11/1977 Morasch et al. .
4,292,870 10/1981 Mericle .
4,306,598 12/1981 Peot .
4,524,812 6/1985 Murphy ..... 144/135.2
4,655,445 4/1987 Morse ..... 144/204.2
4,679,606 7/1987 Bassett ..... 144/253.2
4,858,664 8/1989 Wright .
4,995,435 2/1991 Godfrey .
5,024,257 6/1991 Lloyd ..... 144/1.1
5,094,279 3/1992 Dickey et al. .

*Primary Examiner*—W. Donald Bray

[57] ABSTRACT

A work bench has a stationary planar upper surface and a fence to which a piece of work is clamped. The fence may be moved so that the position of the work piece may be adjusted. Once in the desired position, the work piece remains immovable. A carriage slides beneath the upper surface and a router is mounted on the carriage. The router bit extends through an elongated slot in the upper surface and into contact with the immovable work piece. As the carriage slides the router cuts the work piece. The fence has a base which rotates on top of the upper surface and a bracket slides on rails formed on top of the base. Knobs are provided for tightening the base to the upper surface and the bracket to the base to prevent such rotation and sliding.

13 Claims, 8 Drawing Sheets

FIG. 4.
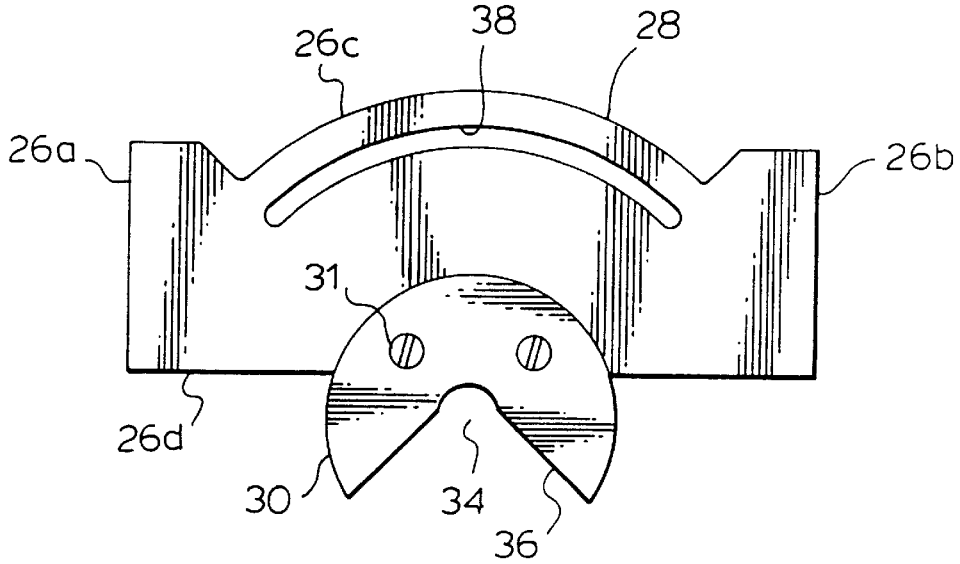
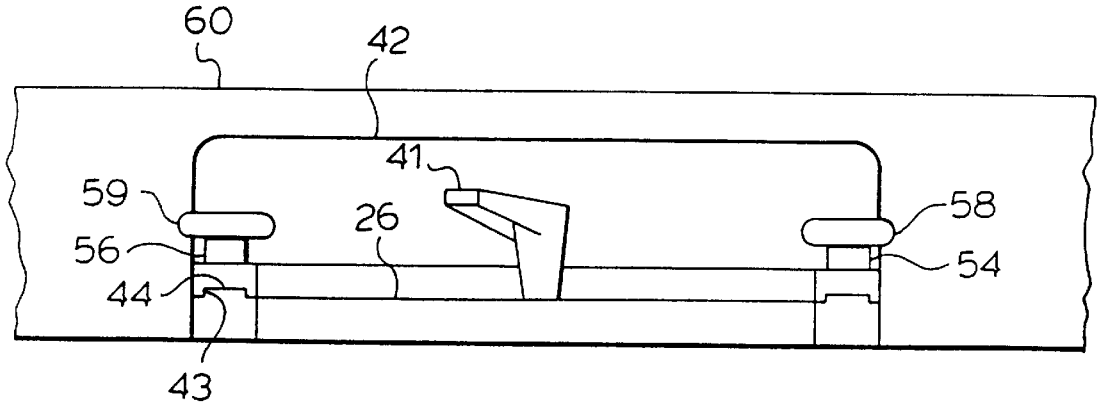
FIG. 5.

FIG. 12.
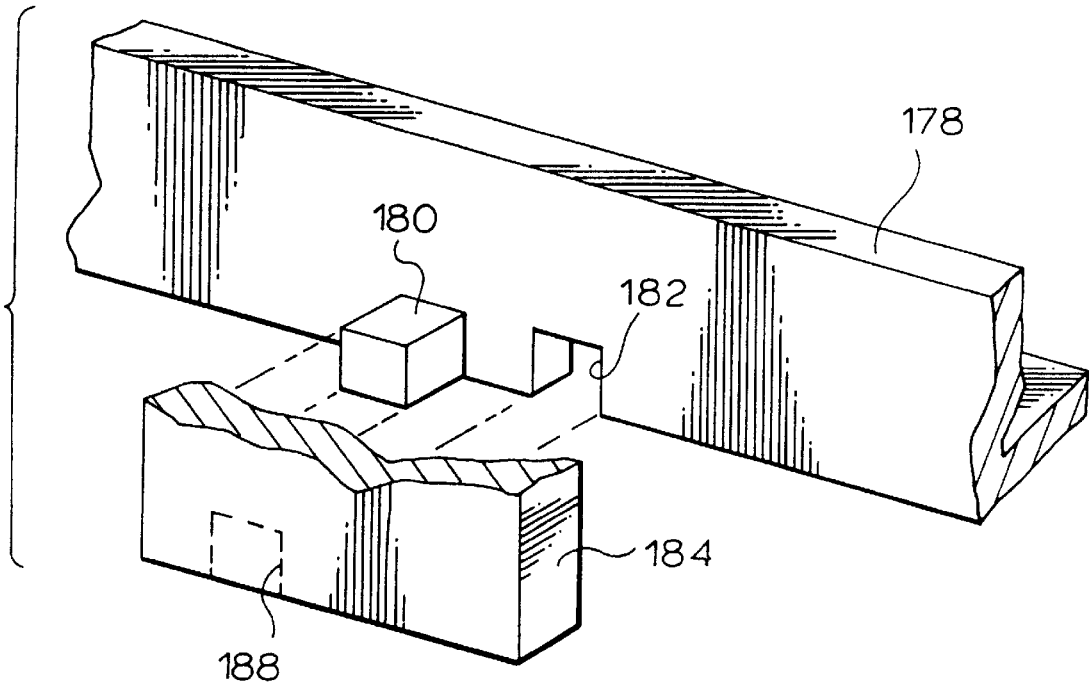
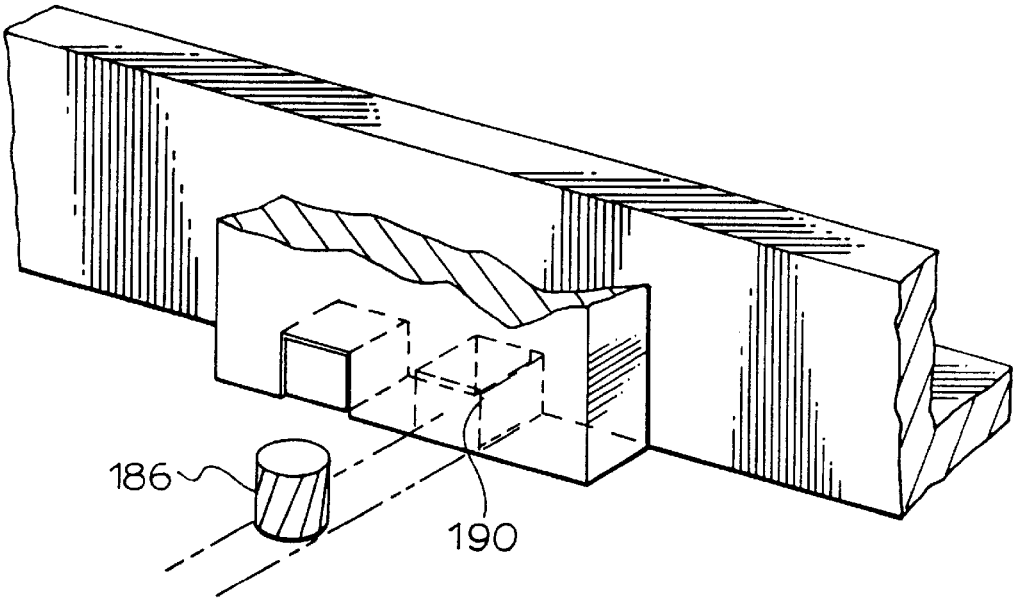
FIG. 13.

WORK BENCH

BACKGROUND OF THE INVENTION

This invention relates to work benches for cutting pieces of wood, plastic and other material. More particularly the invention relates to a work bench equipped with a jig or fence having means by which a piece of work may be maintained in a wide variety of different positions. Such means facilitates the cutting of the work piece. The invention also relates to a work bench having a router mounted for sliding beneath a stationary table top.

It is well known to provide work benches with jigs or fences to maintain the correct positional relationship between a piece of work and a cutting tool. U.S. Pat. No. 3,172,417 to Zulkowitz et al and U.S. Pat. No. 4,679,606 to Bassett both show jigs or fences which may be moved to adjust the position of a piece of work for shaping of its edges or for routing. The jigs or fences of such work benches are usually intended to guide a piece of work as it is moved through a cutting tool such as a saw or a router.

A shortcoming of many such work benches is that they usually are not capable of maintaining a piece of work in the correct position throughout the cutting operation. During cutting the piece of work may deviate from the correct position by reason of warps, knots and other imperfections in the work piece. Heavier work pieces are especially difficult to guide accurately through the cutter because they are awkward to handle. An inaccurate cut is the usual result where the work piece deviates from the correct position during cutting and this result is particularly troublesome where the cutter is a router.

Where a router is used to form dovetails and pins in order to connect two work pieces together, the cuts must be at precise angles for the two pieces to fit together properly. If the angles are not correct, even slightly so, the joints may be too tight for easy assembly or they may be too loose and wobbly.

Another shortcoming of known work benches is that the jig or fence with which many are equipped are capable of only limited movement. Only with difficulty can dovetails and pins be formed by means of some such fences and in the case of others it is not possible to form such cuts at all.

SUMMARY OF THE INVENTION

It is an object of this invention, according to one of its aspects, to provide a work bench having means for maintaining a piece of work stationary during the cutting operation. The cutter but not the work piece moves during the cutting operation and many of the problems encountered when the work piece is moved are eliminated.

An object of another aspect of the invention is to provide a work bench having a jig or fence which may be maintained in a wide variety of different positions. The work bench is as a result particularly suitable for cutting dovetails and pins or tenons and mortises in a piece of work.

The first object is accomplished by a router table including: a table having a stationary planar upper surface and an elongated slot formed therein; a fence which is adjustably mounted on the upper surface and to which a work piece may be clamped such that the work piece may be adjustably positioned on the upper surface and maintained immovable in a desired position during the routing operation; a carriage slideably mounted beneath the upper surface; and a router mounted to the carriage and having a bit which extends through the slot and projects upwardly of the upper surface to engage the work piece, the bit cutting out an elongated groove in the immovable work piece as the carriage slides beneath the upper surface.

The second object is accomplished by a fence having a base which is rotatably mounted to the upper surface of a work bench table; first adjustment means for selectively preventing the base from rotating with respect to the upper surface; a bracket slideably mounted to the base and having an elongated wall to which the work piece may be clamped; and second adjustment means for selectively fixing the bracket to the base for preventing the bracket from sliding relative thereto.

DESCRIPTION OF THE DRAWINGS

The router table of the invention is described with reference to the accompanying drawings in which:

FIG. 4 is a view of the lower wall of the base of the fence, in enlarged scale;

FIG. 5 is an elevation of the bracket and base of the fence, in enlarged scale, from the rear of the router table;

FIGS. 12 and 13 are perspective views of the fence and a work piece showing the manner in which a number of mortises having side walls which are parallel to each other is formed in a piece of work.

Like reference characters refer to like parts throughout the description of the drawings.

DESCRIPTION OF THE PREFERRED EMBODIMENTS

Figure 1:
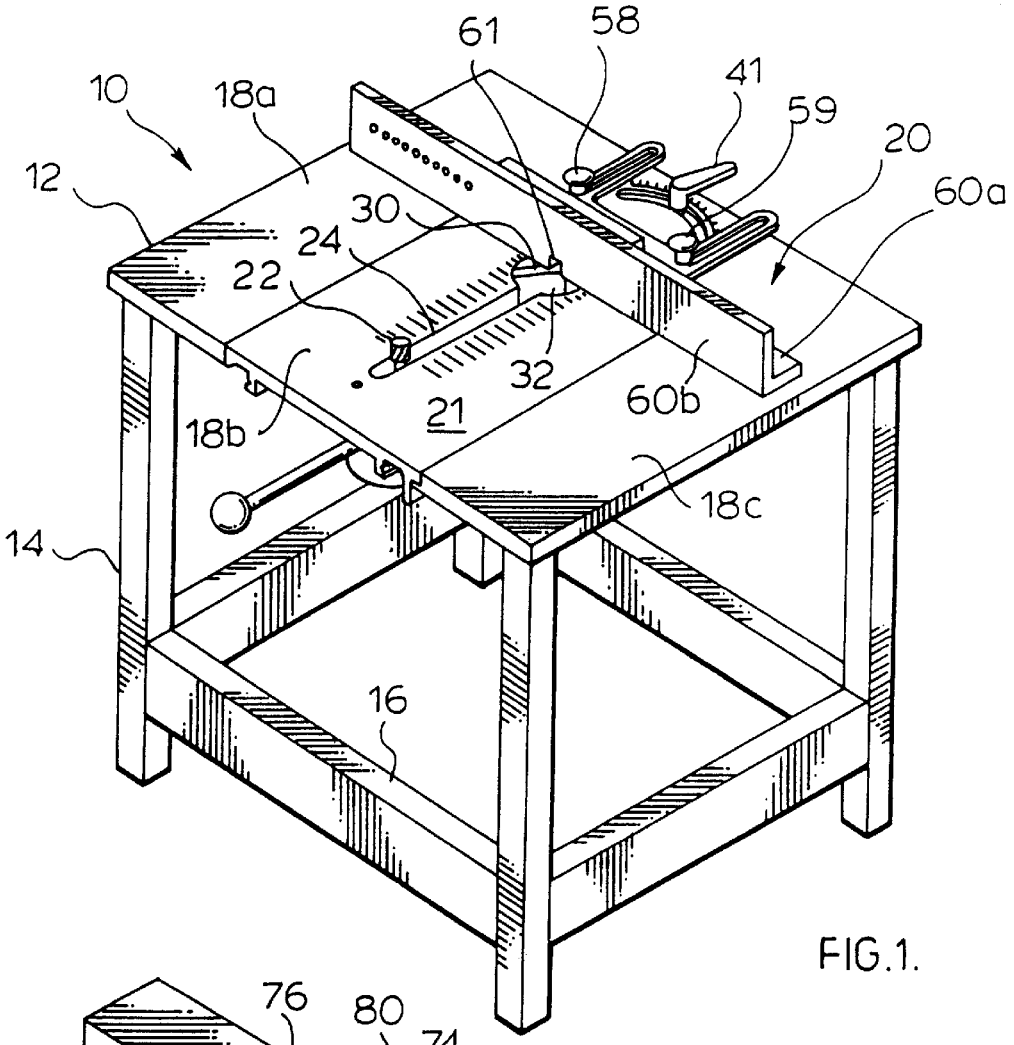
FIG. 1 is a perspective view of the router table according to the invention.

With reference to FIG. 1, the router table of the invention is indicated by the numeral 10 and includes a stationary top 12 and four legs 14. The legs extend downwardly from the top and are interconnected adjacent to their lower ends by horizontal braces 16 to reduce undesirable movement of one leg relative to another.

The table top is composed of three panels 18*a, b* and *c* which are disposed side by side and which have co-planar upper surfaces. The outer panels 18*a, c* are preferably composed of wood and the legs are connected to them while the intermediate panel 18*b* is composed of metal, preferably aluminum.

A fence generally 20 is mounted upon the upper surface 21 of the table and a bit 22 of the router extends through a slot 24 formed in the intermediate panel 18*b* of the table.

Figure 3:
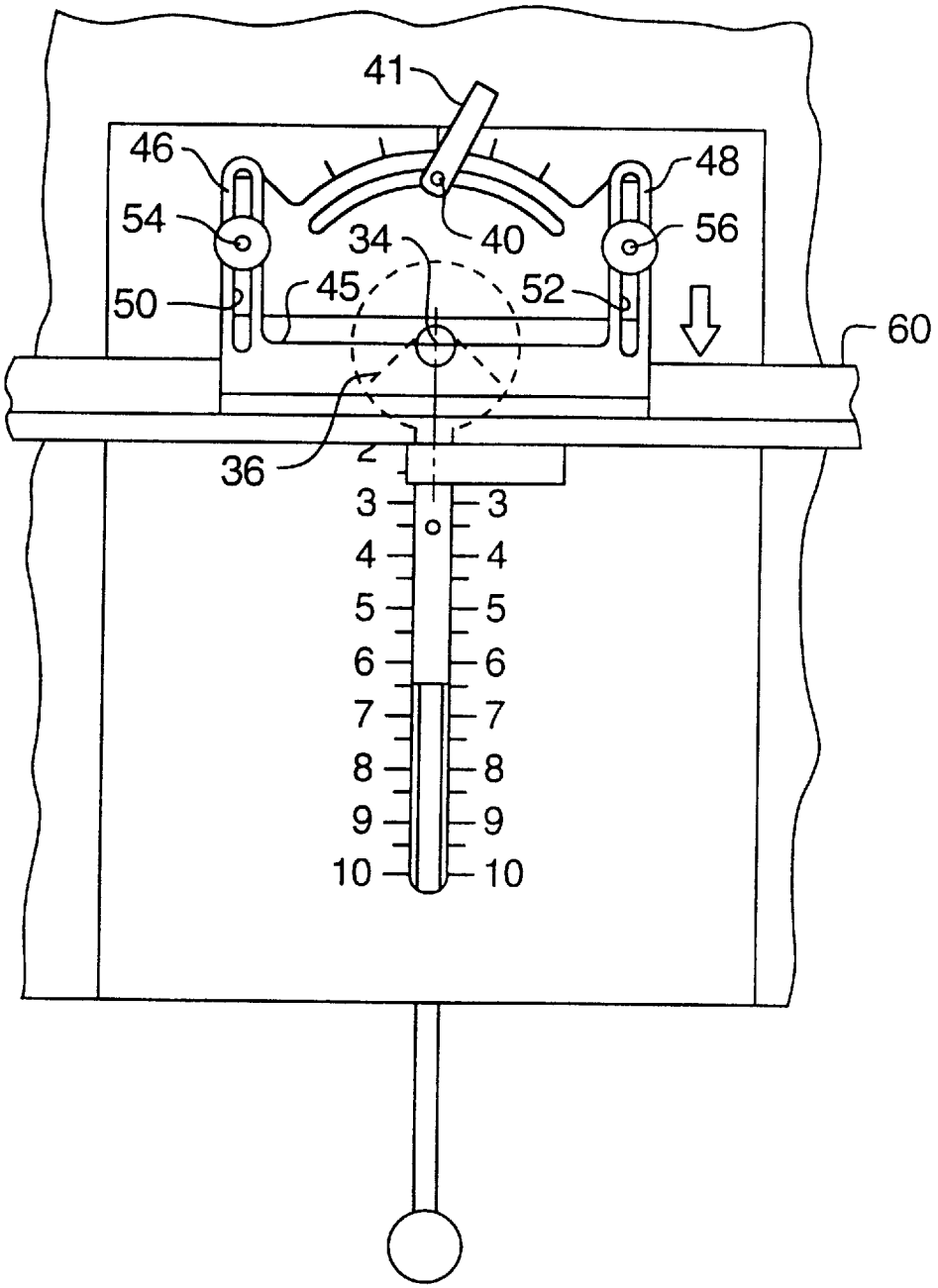
FIG. 3 is a plan view, in enlarged scale, of the central panel of the router table.

With reference to FIGS. 1, 3 and 4 the fence includes a base 26 which rests upon the upper surface of the table. The base has parallel side edges 26*a, b*, a rear edge 26*c* and a forward edge 26*d*. The rear edge has a curved intermediate portion 28 and the forward edge is straight.

A disc 30 is fastened to the downward facing surface of the base by means of screws 31. The disc is received in a conforming circular opening 32 in the table top. The diameter of the opening is slightly larger than the diameter of the disc so that the disc may freely rotate in the opening but not move laterally or forward and backward in it. The disc and the base to which it is attached rotate about a vertical axis 34 on which the center of the disc and the opening lie.

A segment 36 is removed from the disc at its forward end to provide clearance for the bit. As well, shavings produced during the routing operation may fall to the floor through the opening in the disc. The shavings will accordingly not collect on the table and interfere with the operation.

An arc-shaped slot 38 is formed in the base for receipt of a threaded stud 40. The lower end of the stud is tightened into a threaded opening in the table top. The stud projects upwardly through the slot and its upper end mates threadably with the threaded bore of a first adjustment means in the form of a handle 41.

Rotation of handle 41 in one direction causes it to move downward into contact with the upper wall of the base and prevents the base from rotating relative to the table top. Rotation of the handle in the opposite direction allows the base to rotate relative to the table top.

With reference to FIGS. 3 and 5, a U-shaped bracket 42 is mounted upon the base. The bracket is provided with a pair of longitudinally extending grooves 43 on each side thereof for accommodation of rails 44 formed on the upper surface of the base. The rails and grooves cooperate with one another to permit the bracket to slide but not rotate relative to the base.

The bracket has a central web 45 which extends between a pair of flanges 46, 48. An elongated opening 50, 52 is formed in each flange. The openings are parallel to one another and receive threaded studs 54, 56. The studs are tightened into threaded openings in the base and their upper ends are threadably received in the bores of second adjustment means in the form of knobs 58, 59.

Like handle 41, rotation of the knobs in one direction causes the knobs to move downward or tighten into contact with the upper wall of the bracket while rotation in the opposite direction causes the knobs to loosen and to permit the bracket to slide relative to the base.

An elongated angle member 60 is attached integrally to the bracket so that it too may slide but not rotate relative to the base. The lower limb 60*a* of the angle member rests on the upper surface of the table while its upstanding limb 60*b* serves as a surface to which a work piece may be clamped. The clamps may be conventional C-clamps which are not illustrated but are well known to those familiar with the art. A slot 61 is formed in the angle member for receipt of bit 22.

Figure 2:
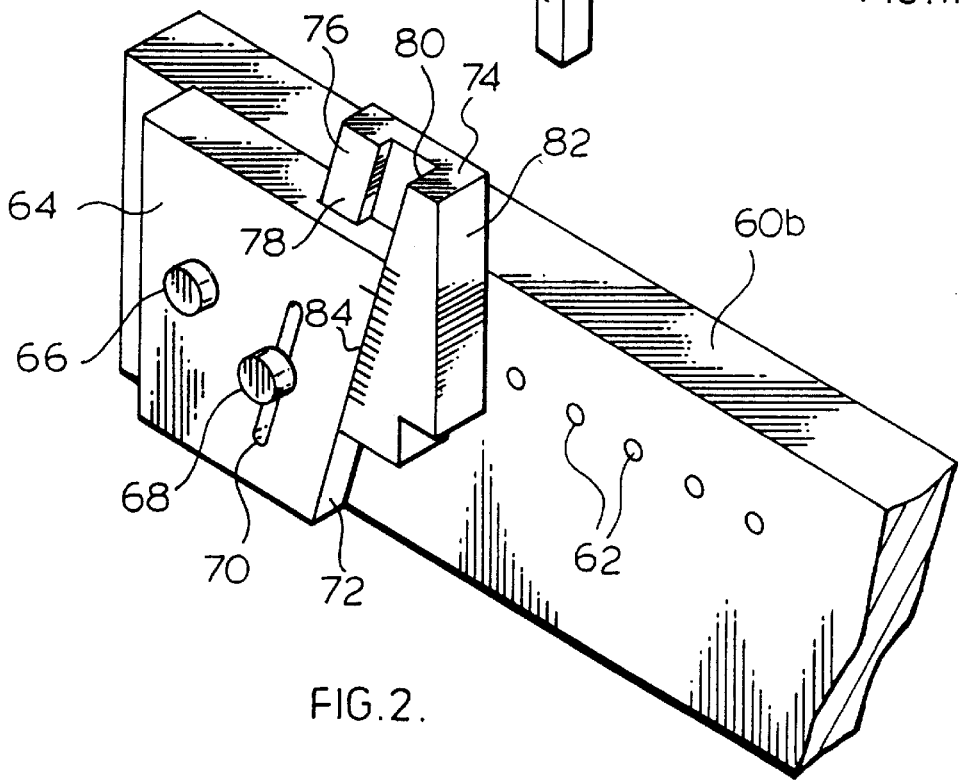
FIG. 2 is a fragmentary perspective view, in enlarged scale, of a mechanism for adjusting the position of a piece of work on the fence.

With reference to FIG. 2, a number of threaded apertures 62 are spaced horizontally along limb 60*b*. A locating block 64 rests on the table top and abuts the limb. The block is provided with a first locking means in the form of a threaded indexing pin 66 which extends through the block and into a selective aperture 62. The block is also provided with a second locking means in the form of an adjusting pin 68 which has a threaded outer wall and which is received in slot 70.

Block 64 has a lateral surface 72 offset from the vertical along which a sliding block 74 moves. That block has an elongated flange 76 which is received in a conforming groove 78 formed in the block. A lateral surface 80 of the sliding block contacts a lateral surface 72 of the block.

As the sliding block moves upward relative to the locating block its lateral surface 82 moves horizontally to the right in FIG. 2 but always remains vertical. Downward movement of the sliding block causes surface 82 to move to the left. Adjusting pin 68 is provided for fixing the block in the required position.

A gauge 84 is imprinted on the outer wall of the sliding block for indicating the position of surface 82 relative to the locating block.

Figure 6:
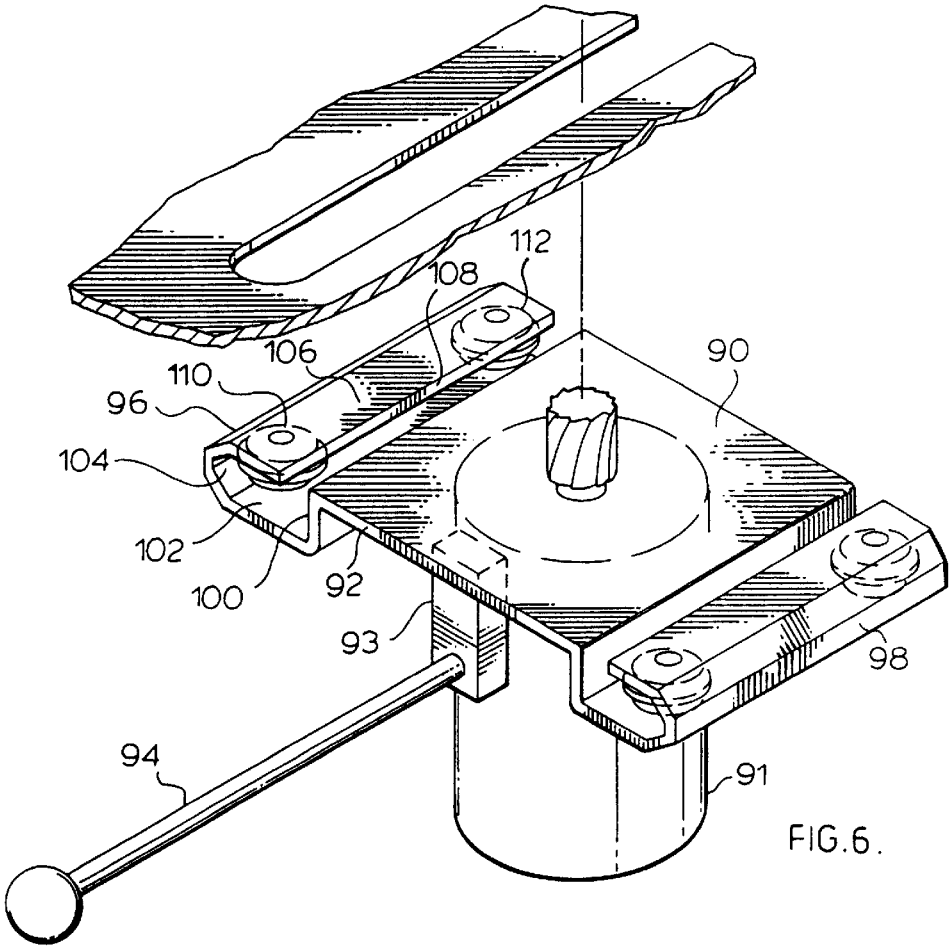
FIG. 6 is a perspective view of the carriage, in enlarged scale, together with a portion of the top of the table.
Figure 7:
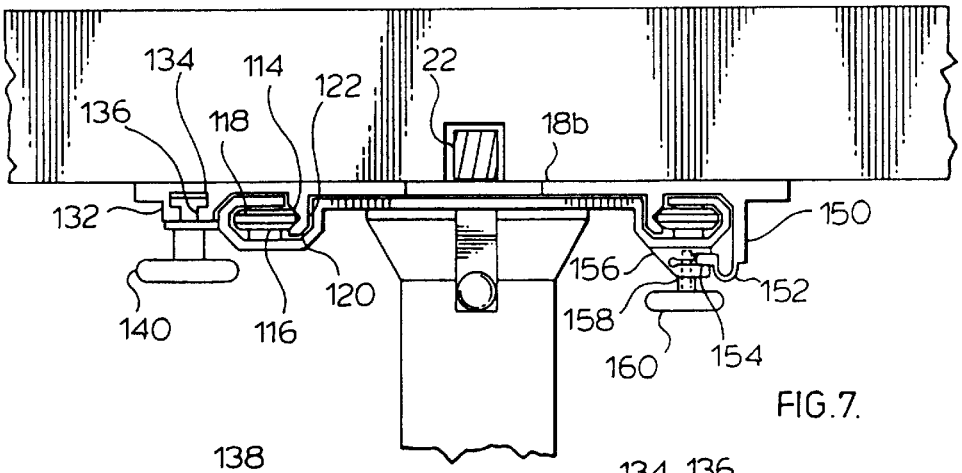
FIG. 7 is an elevation of the carriage from the front together with a portion of the table top.
Figure 8:
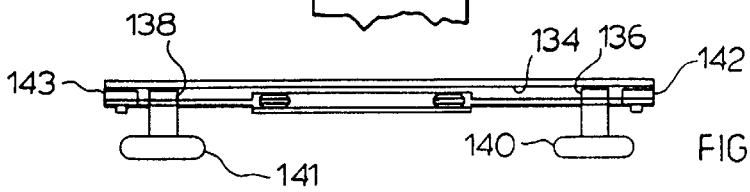
FIG. 8 is an elevation of the carriage from one side.

With reference to FIGS. 6, 7 and 8 a carriage 90 to which a router 91 is mounted has a flat horizontally extending central plate 92. A bar 93 extends downward from the central plate and a horizontally extending handle 94 is provided for moving the carriage.

Lateral portions 96, 98 are integrally connected to the side edges of the central plate. Each lateral portion is the same as the other and only one, namely 96 will be described. That lateral portion commences at an inner wall 100 which extends vertically downward from a side edge of the central plate and terminates at a lower wall 102. The latter wall extends horizontally outward and terminates at an outer wall 104 and the outer wall extends upward and terminates at an upper horizontal wall 106. The upper wall extends parallel to but is spaced apart from the lower wall 102 and terminates at an edge 108 which faces and is spaced apart from inner wall 100.

A pair of rollers 110, 112 are mounted for rotation in the space between the lower and upper walls 102, 106. Each roller has lower and upper circular portions 114, 116 separated by a central portion 118 of larger diameter. The roller runs in the groove 120 of a track 122. The track runs parallel to the longitudinal axis of slot 24. The tracks are integral with the central panel 18*b* of the table and run adjacent to slot 24 along its entire length.

An enlarged distal section 132 extends downward from one of the lateral edges of the central panel. A T-shaped slot 134 is formed in that section and the slot extends longitudinally along the entire length of the assembly i.e. from its front to its rear walls. A pair of conventional T nuts 136, 138 are slideably received in the slot. The nuts are located in front of and behind the carriage and serve as adjustable stops to limit its length of travel. The position of the nuts can be moved by loosening knobs 140, 141. Permanent stop means 142, 143 are connected at opposite ends of the slot for preventing the adjustable stops from sliding out of the slot.

With reference again to FIG. 7, on the side of the assembly opposite the T slot a flange 150 is formed. The flange extends downward and terminates at a U-shaped bracket 152. The bracket is connected to a bar 154 and that bar is received between the jaws of an underhanging element 156. The latter element is attached to central plate 92 of the carriage. A threaded stud 158 passes through openings in the two jaws and a knob 160 facilitates turning of the stud to open and close the jaws. When the jaws are closed bar 154 is squeezed between them thereby preventing the carriage from moving.

Figure 9:
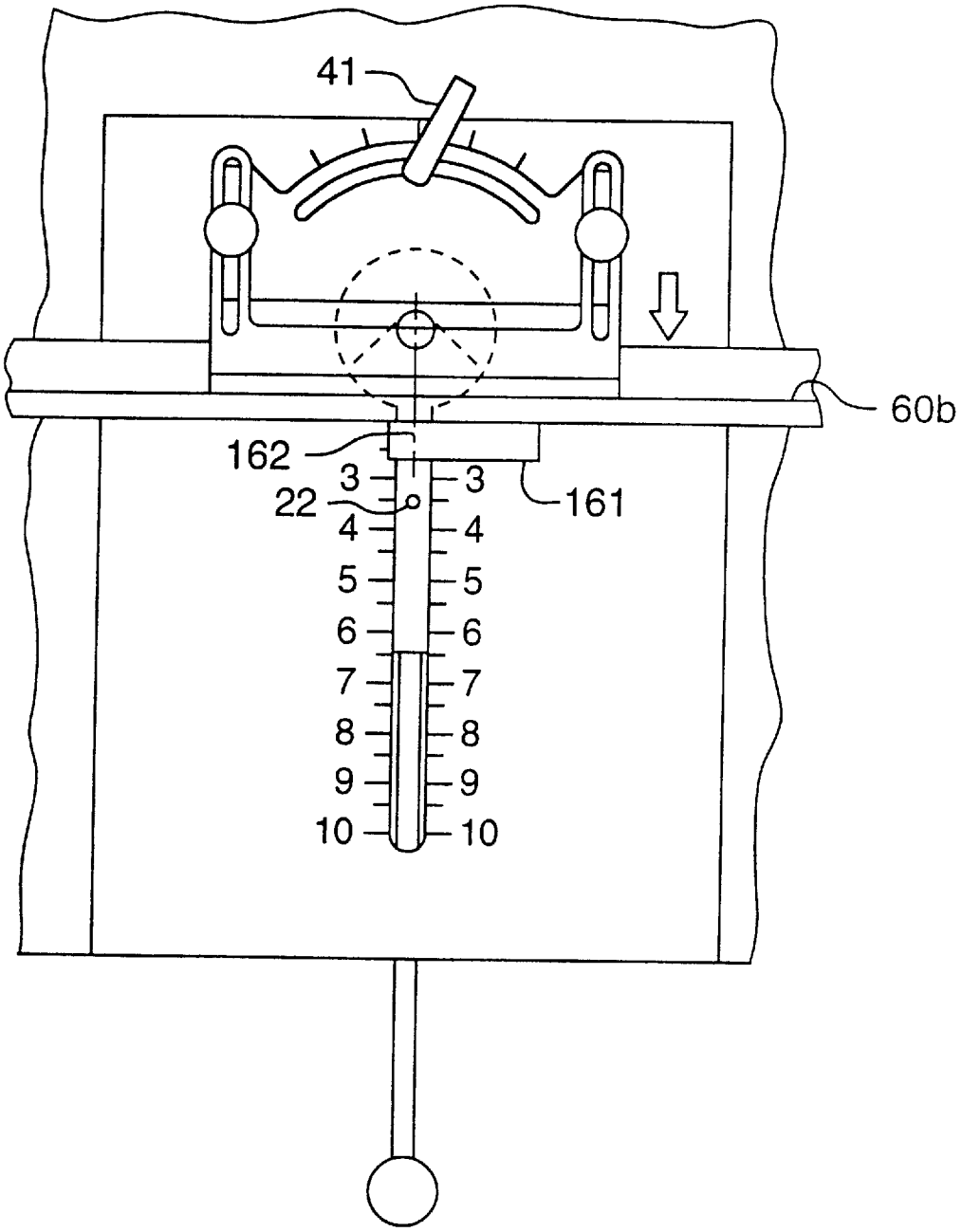
FIGS. 9, 10 and 11 are plan views of the central panel of the router table showing the manner in which a dovetail pin having non-parallel side walls is formed in a piece of work.
Figure 10:
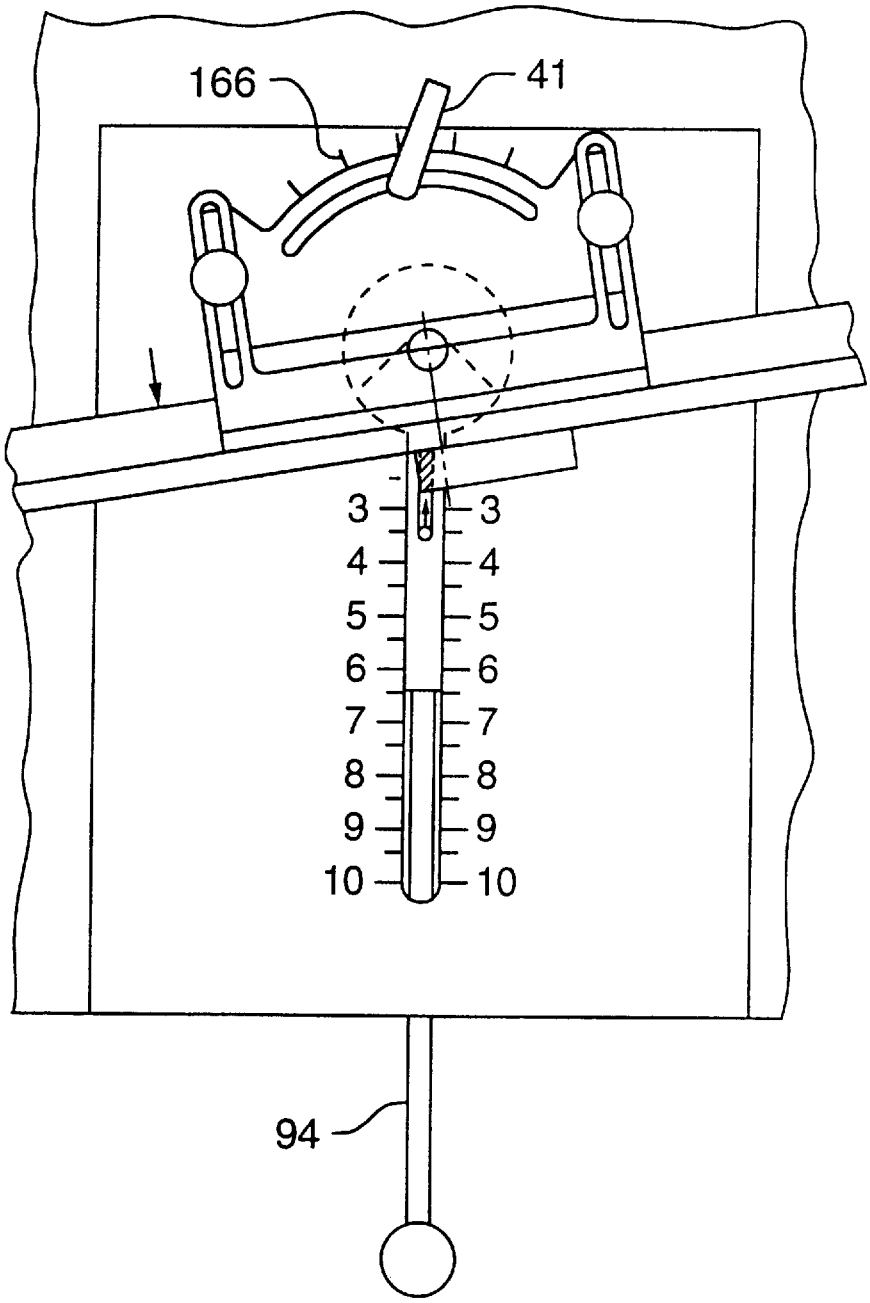

The procedure for cutting a dovetail pin in a piece of work is described with reference to FIGS. 9 to 11. The work piece 161 is clamped to the limb 60*b* of the fence so that the center line 162 of the dovetail pin to be cut is on the line of travel of bit 22. Handle 41 is then loosened to allow the base of the fence to rotate until, as illustrated in FIG. 10, the bit is in position to make the required cut in the work piece.

Gauge 166 on the upper wall of the table top is provided so that the angle that the base is rotated from the neutral position can be ascertained. The base is in the neutral position in FIG. 9.

Handle 41 is then tightened so that the work piece is held stationary and the bit is advanced by means of handle 94 to make the required first cut.

Figure 11:
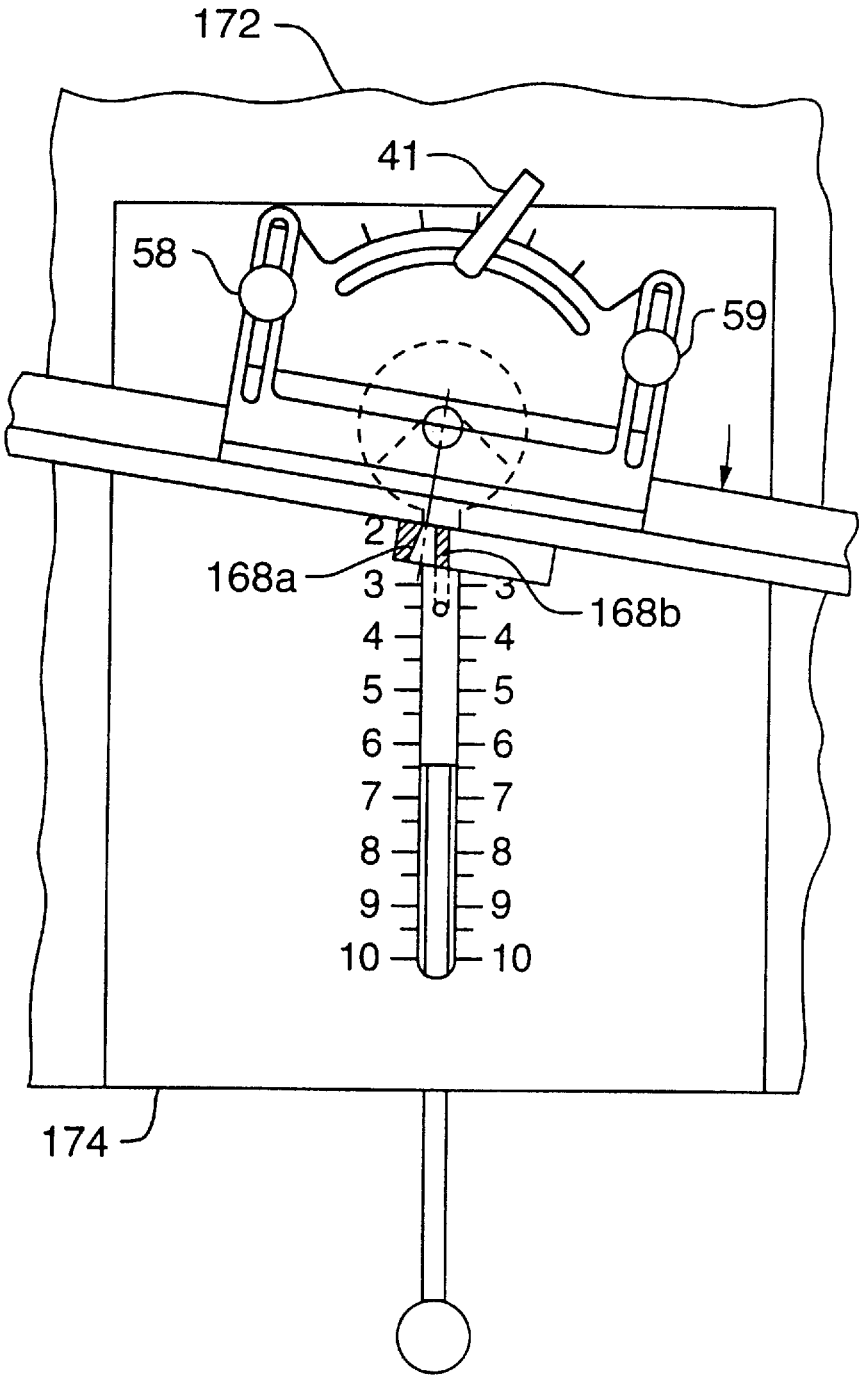

The bit is then retracted and as illustrated in FIG. 11, the handle 41 is loosened and the fence is rotated in the opposite direction until the angle from the neutral position is the same in that direction as it was in the opposite direction when the first cut was made. The work piece is cut a second time.

The pin from the foregoing operation will have oppositely facing side walls 168*a,b* which are symmetrically disposed about the longitudinal axis 170 of the pin.

The width of the dovetail pin can be adjusted by means of knobs 58, 59. Should a thinner pin be desired, the knobs are loosened to allow the fence to be moved toward the rear edge 172 of the table. Movement of the fence toward the forward edge 174 of the table will result in a wider pin.

The procedure for cutting tenons and mortises in a work piece is described with reference to FIGS. 12 and 13. For the purposes of this discussion such cuts have side walls which are parallel to one another and are to be contrasted with dovetails and pins which have non-parallel side walls.

Fence 178 is provided with a short bar 180 adjacent to slot 182. The cross-section of the bar is preferably slightly less than the cross-section of the cut which is made in work piece 184 by the bit 186.

With reference to FIG. 12, the work piece is first clamped to the fence and a mortise is cut in it. The work piece is then moved to the left and the bar is inserted in the mortise as illustrated in FIG. 13 and a second mortise 190 is cut in the work piece. The operation can be repeated if additional mortises are to be cut into the work piece. Bar 180 ensures that the spacing between adjacent mortises remains uniform.

It will be understood of course that modifications can be made in the preferred embodiments illustrated and described herein without departing from the scope and purview of the invention as defined in the appended claims.

The embodiments of the invention in which an exclusive property or privilege is claimed are defined as follows:

1. A router table including:

a table having a stationary planar upper surface and an elongated slot formed therein;

a fence which is adjustably mounted on said upper surface and to which a work piece may be clamped such that the work piece may be adjustably positioned on said upper surface and maintained immovable in a desired position during the routing operation;

a carriage slideably mounted beneath said upper surface;

and a router mounted to said carriage and having a bit which extends through said slot and projects upwardly of said upper surface to engage the work piece, said bit cutting out an elongated groove in the immovable work piece as said carriage slides beneath said upper surface, said slot extending across said table and beneath said fence and defining an elongated path along which said bit travels as said carriage slides beneath said upper surface such that as said carriage slides, said bit cuts out an elongated groove in the immovable work piece, said fence having an opening above said slot through which said bit may pass.

2. A router table including:

a table having a stationary planar upper surface and an elongated slot formed therein;

a fence which is adjustably mounted on said upper surface and to which a work piece may be clamped such that the work piece may be adjustably positioned on said upper surface and maintained immovable in a desired position during the routing operation;

a carriage slideably mounted beneath said upper surface;

a router mounted to said carriage and having a bit which extends through said slot and projects upwardly of said upper surface to engage the work piece, said bit having an axis of rotation which travels in a straight line as said carriage slides beneath said table and which cuts out an elongated groove in the immovable work piece as said carriage slides beneath said upper surface; and said slot extending across said table and beneath said fence and defining an elongated path along which said bit travels as said carriage slides beneath said upper surface such that as said carriage slides, said bit cuts out an elongated groove in the immovable work piece, said fence having an opening above said slot through which said bit may pass.

3. A router table including:

a table having a stationary planar upper surface and an elongated slot formed therein;

a fence which is adjustably mounted on said upper surface and to which a work piece may be clamped such that the work piece may be adjustably positioned on said upper surface and maintained immovable in a desired position during the routing operation;

a carriage slideably mounted beneath said upper surface;

and a router mounted to said carriage and having a bit which extends through said slot and projects upwardly of said upper surface to engage the work piece, said bit having an axis of rotation which travels in a straight line as said carriage slides beneath said table and which cuts out an elongated groove in the immovable work piece as said carriage slides beneath said upper surface, said fence including a base mounted to said table for rotation about an axis lying on the projection of said straight line, and said slot extending across said table and beneath said fence and defining an elongated path alone which said bit travels as said carriage slides beneath said upper surface such that as said carriage slides, said bit cuts out an elongated groove in the immovable work piece, said fence having an opening above said slot through which said bit may pass.

4. The router table as claimed in claims 1, 2 or 3 further including adjustable stop means for limiting the length of travel of said carriage.

5. The router table as claimed in claims 1, 2 or 3 wherein said fence includes a base which is rotatably mounted to said table and which is disposed on said upper surface; first adjustment means for selectively preventing said base from rotating with respect to said upper surface; a bracket slideably mounted to said base and having an elongated wall to which the work piece is clamped; second adjustment means for selectively fixing said bracket to said base for preventing said bracket from sliding relative to said base.

6. The router table as claimed in claims 1, 2 or 3 wherein said fence includes a base which is rotatably mounted to said table and which is disposed on said upper surface; first adjustment means for selectively preventing said base from rotating with respect to said upper surface; a bracket slideably mounted to said base and having an elongated wall to which the work piece is clamped; second adjustment means for selectively fixing said bracket to said base for preventing said bracket from sliding relative to said base, said bracket having a pair of elongated parallel openings each receiving a separate threaded stud, each said stud being fixed to said base and extending through and projecting upwardly of said opening, a pair of knobs each having a threaded bore for mating with a separate said stud, rotation of said knob in one direction causing said knob to engage said bracket and to prevent sliding of said bracket with respect to said base and rotation of said knob in the opposite direction allowing said bracket to slide relative to said base.

7. A work bench for cutting a piece of work including:

a fence having a base which is mounted to said table for rotation about an axis and which is disposed on its upper surface;

first adjustment means for selectively preventing said base from rotating with respect to said upper surface;

a bracket mounted to said base and having an elongated wall to which a work piece is clamped, said bracket being slidable relative to said base suck that the work piece may be caused to advance radially toward or to retreat radially from said axis; and second adjustment means for selectively fixing said bracket to said base for preventing said bracket from sliding relative to said base.

8. The work bench as claimed in claim 7 wherein said base has a rail which is accommodated in a groove formed in said bracket for allowing sliding but not rotation of said bracket relative to said base, said bracket having a pair of elongated parallel openings each receiving a separate threaded stud, each said stud being fixed to said base and extending through and projecting upwardly of said opening, a pair of knobs each having a threaded bore for mating with a separate said stud, rotation of said knob in one direction causing said knob to engage said bracket and to prevent sliding of said bracket with respect to said base and rotation of said knob in the opposite direction allowing said bracket to slide relative to said base.

9. The work bench as claimed in claims 7 or 8 further including a locating block movable along said elongated wall; locking means for securing said block immovably to said elongated wall; a sliding block slideable relative to said locating block and having a lateral vertical wall which abuts the work piece during cutting thereof; and second locking means for securing said sliding block immovably to said locating block.

10. A work bench for cutting a piece of work including:

a fence having a base which is mounted to said table for rotation about an axis which is disposed on its upper surface;

first adjustment means for selectively preventing said base from rotating with respect to said upper surface;

a bracket mounted to said base and having an elongated wall to which a work piece is clamped;

second adjustment means for selectively fixing said bracket to said base for preventing said bracket from sliding relative to said base;

said base having a rail which is accommodated in a groove formed in said bracket for allowing sliding but not rotation of said bracket relative to said base, said bracket having a pair of elongated parallel openings each receiving a separate threaded stud, each said stud being fixed to said base and extending through and projecting upwardly of said opening, a pair of knobs each having a threaded bore for mating with a separate said stud, rotation of said knob in one direction causing said knob to engage said bracket and to prevent sliding of said bracket with respect to said base and rotation of said knob in the opposite direction allowing said bracket to slide relative to said base.

11. The work bench as claimed in claim 10 further including:

a locating block movable along said elongated wall;

locking means for securing said block immovably to said elongated wall;

a sliding block slideable relative to said locating block and having a lateral vertical wall which abuts the work piece during cutting thereof; and second locking means for securing said sliding block immovably to said locating block.

12. The router table as claimed in claim 1 further including a handle attached to said carriage and extending outwardly of said table for manual movement of said carriage, said handle being the only means by which said carriage is caused to slide.

13. The router table as claimed in claim 12 further including means for clamping the work piece to the fence such that the workpiece remains immovable during the routing operation.

* * * * *